US008514543B2

(12) United States Patent
Myers

(10) Patent No.: US 8,514,543 B2
(45) **Date of Patent: *Aug. 20, 2013**

(54) REMOTE CONTROLLED LOCKING ELECTROSHOCK STUN DEVICE WITH GPS TRACKING, ALCOHOL MONITORING AND VOICE COMMUNICATIONS AND METHODS OF USE

(75) Inventor: Steven Bradley Myers, Denver, CO (US)

(73) Assignee: Steven Bradley Myers, Denver, CO (US)

( * ) Notice: Subject to any disclaimer, the term of this patent is extended or adjusted under 35 U.S.C. 154(b) by 13 days.

This patent is subject to a terminal disclaimer.

(21) Appl. No.: 13/136,173

(22) Filed: Jul. 27, 2011

(65) Prior Publication Data

US 2013/0027837 A1 Jan. 31, 2013

(51) Int. Cl.
*F42B 8/00* (2006.01)

(52) U.S. Cl.
USPC ..... 361/232; 102/502

(58) Field of Classification Search
USPC ..... 361/232; 102/502; 42/1.08
See application file for complete search history.

(56) References Cited

U.S. PATENT DOCUMENTS

| | | | | |
|---|---|---|---|---|
| 7,586,732 | B2 * | 9/2009 | Myers | 361/232 |
| 8,154,844 | B2 * | 4/2012 | Brown | 361/232 |
| 2012/0298119 | A1 * | 11/2012 | Reese et al. | 128/875 |

* cited by examiner

*Primary Examiner* — Danny Nguyen

(57) ABSTRACT

A apparatus able but not limited to monitor alcohol levels, track by GPS have voice communications and administer a incapacitating electric shock to a person, which comprises a portable power source, at least one pair of electrodes operatively associated with the power source and that are configured to track, monitor, communicate and deliver an electrical shock to the person's body, a locking mechanism configured to secure the tracking, monitoring and communications device with electrodes at a desired position on said person's body operated by at a remote location capable of tracking, monitoring, communicating and triggering an electric shock.

10 Claims, 5 Drawing Sheets

REMOTE CONTROLLED LOCKING ELECTROSHOCK STUN DEVICE WITH GPS TRACKING, ALCOHOL MONITORING AND VOICE COMMUNICATIONS AND METHODS OF USE

CROSS REFERENCE TO RELATED PATENT

The present application claims the benefits of U.S. Pat. No. 7,586,732 B2. Issued Sep. 9, 2009, entitled "Remote controlled locking electroshock stun device and method of use." The contents are incorporated herein.

BACKGROUND OF THE INVENTION

In law enforcement it is often necessary for parole officers, police, courts etc. to be able to track (GPS) and monitor (alcohol) and communicate (voice) with persons on probation, paroled from prison, released from jail or under house arrest, for example, it is typical that when a person is paroled from prison they are tracked (GPS) and monitored (alcohol) as a part of their release, should they violate the terms of their probation they may cause harm or endanger other persons, heretofore, a means of control can be accomplished by using a tracking device (GPS) and/or to monitor (alcohol) and communicate (voice) with a person via telephone or global positioning satellites (GPS) and administer a electroshock stun.

A further concern exist as to a method of control that may be needed when a person on parole/probation is in violation with the terms of their parole/probation, for example, a person on parole/probation for child sex crimes has been ordered to stay away from schools, parks and other locations frequented by children, when the global positioning satellite (GPS) tracking system sets off an alert at a monitoring center, at present all the monitoring center can do is alert the parolee/probationer to leave the area or authorities will be notified, the parolee/probationer may have dangerous intentions and there are no immediate forms of stopping a possible abduction. Moreover, with the present invention several thing can be done, trigger a vibrator or siren to warn others, or in extreme cases where the a parolee/probationer disregards all other deterrents the monitoring center can initiate a remote controlled electroshock, pulsating, incapacitating stun to incapacitate an individual until authorities can apprehend the person.

FIELD OF INVENTION

The present invention generally relates to devices and methods for tracking (GPS), monitoring (alcohol), communicating (voice) and administering an electric shock to a target. More specifically, embodiments of the present invention provide a fully automated, remote controlled power source for tracking (GPS), monitoring (alcohol), communicating (voice) and administering a non-lethal, pulsating, incapacitating electric shock to a person at a specific point of contact on wearer's body.

DETAILED DESCRIPTION OF DRAWINGS

Figure 1:
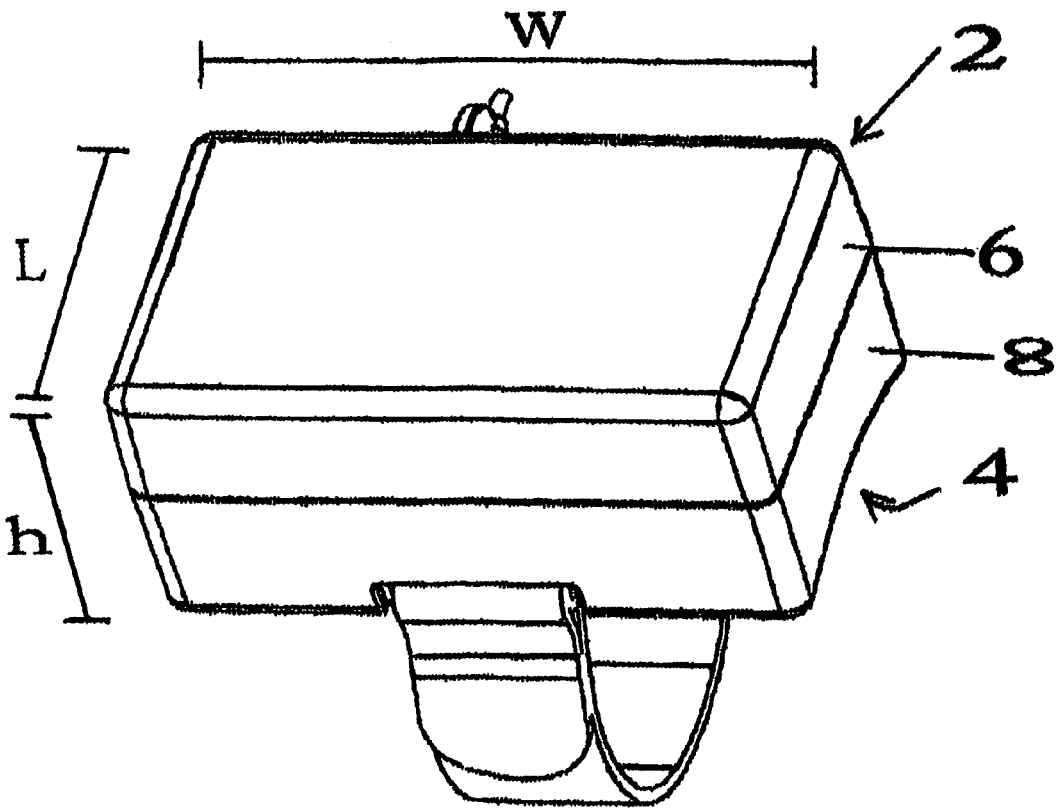
FIG. 1 is a perspective of a power source for the tracking (GPS), monitoring (alcohol), communicate (voice) and administering a non-lethal, pulsating, incapacitating electric shock to a person, in accordance with at least some embodiments of the present invention.

Referring initially to FIG. 1, a fully automated, remote controlled power source for tracking (GPS), monitoring (alcohol), communicating (voice) and administering a non-lethal, pulsating, incapacitating electric shock to a person according to certain embodiments of the present invention is provided. The power source 2 is configured to be placed directly onto the body of a wearer in any number of discreet areas, such as the wrist, ankle, upper arm, or other areas where it may be hidden beneath clothing. Therefore, the power source 2 is preferably small enough in scale so as to fit over the hands and/or feet, and thereby be secured onto the ankles, arms, and/or wrists, of the average person, while remaining sufficiently low in profile so as to remain hidden under clothing, if so desired. In the presently preferred embodiment, the power source 2 has a length "L" of approximately 2 and 3/16 inches, a height "h" of approximately 1 and 5/8 inches, and a width "w" of approximately 3 and 3/16 inches and weighs less than about 16 ounces. As is apparent from FIG. 1, the bottom side 4 of the power source 2 is concaved in shape so as to fit as closely as possible to the wearer and to place the electrodes (not shown in FIG. 1) in close contact with the wearer. The small size of the power source 2 of the present invention is advantageous to other power sources, in that the power source 2 may be located on the wearer's body at a location where it may be hidden underneath clothing; yet, the power source 2 of the present invention is capable of generating an electric shock of equal or greater magnitude than presently available power sources of larger size, which is quite advantageous.

Therefore, the power source 2 allows the wearer to enter public situations, while also allowing law enforcement officials to have the level of control over the wearer that may be necessary to maintain compliance by the wearer of the power source 2.

Figure 2:
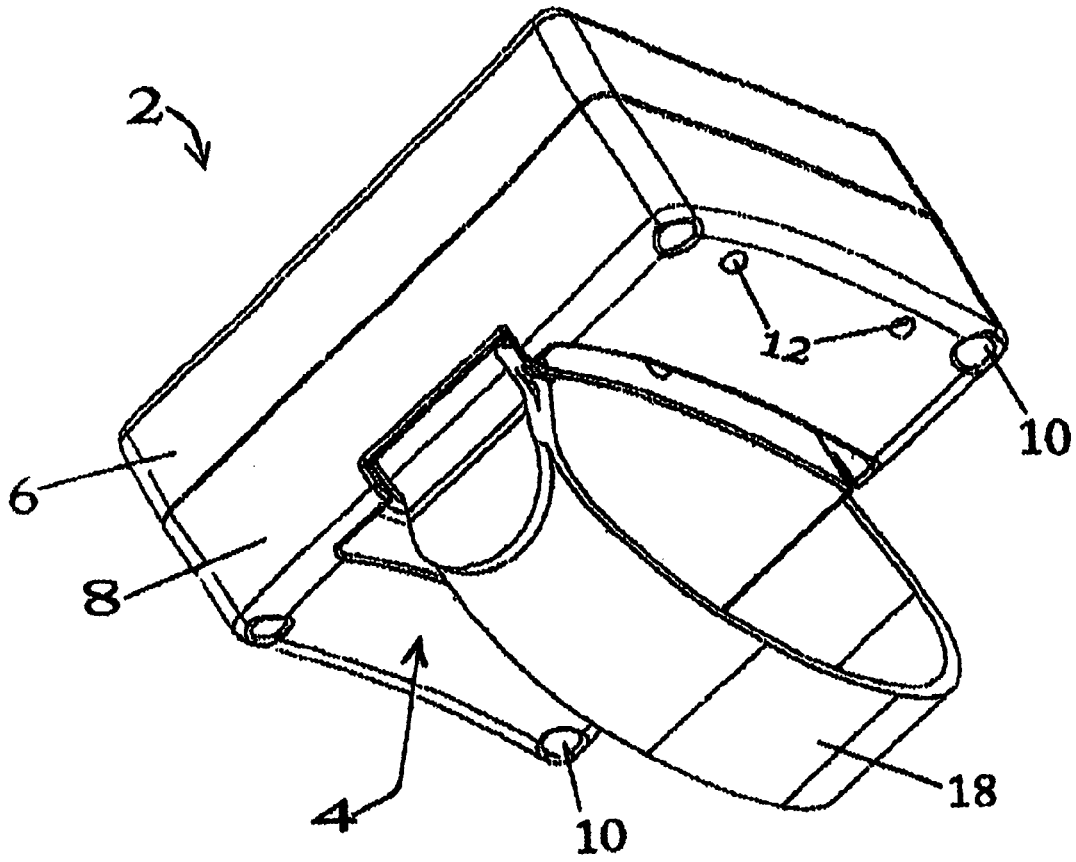
FIG. 2 is a bottom side view of the power source depicted in FIG. 1.

In the depicted embodiment, the power source 2 is encased within a hollow shell, which has a top half 6 and a bottom half 8. The shell encloses the means by which the power source 2 receives radio signals from a remote monitoring center and the means by which the power source 2 generates and delivers an electric shock to the wearer, making it necessary for the shell of the power source 2 to separate into two halves: to facilitate the performance of routine maintenance. Because of this, it is necessary for the top half 6 and the bottom half 8 to be configured so as to be securely connected to each other when worn by a person, thereby preventing the wearer from being able to separate the top half 6 from the bottom half 8 and disable the power source 2. As shown in FIG. 2, the bottom side 4 of the bottom half 8 has means 10 by which the top half 6 may be securely fastened together, such as rivets and screws. In the presently preferred embodiment, the means 10 for securely fastening the two halves together is four screws, one at each corner of the bottom side 4 of the power source 2. The hollow shell must be sufficiently strong so as to protect the inner structures of the power source 2 during use and normal operation and is preferably constructed of a material that is sufficiently sturdy, impact-resistant, and water-resistant, such as metal, and even more preferably a rigid, high impact plastic. This type of material is also such that the power source 2 may be cleaned and sanitized between uses, in the event that a power source 2 is worn by separate people in succession.

The purpose of the power source 2 is to track (GPS), monitor (alcohol) communicate (voice) and deliver an electrical shock to the wearer upon receipt of an appropriate signal from the remote monitoring center. The power source 2 delivers the electric shock to the wearer through two electrodes 12 located on the bottom side 4 of the power source 2. In this regard, but not portending to be limited to in any manner, the following U.S. patents are incorporated herein by reference to assist in providing written description of how the power source 2 may generate and deliver an electric shock to the wearer through the electrodes 12 and therefore how one of skill in the art may implement one or more embodiments of the present invention: U.S. Pat. No. 4,200,809 to Madsen, U.S. Pat. No. 4,120,053 to Rhoads et al., U.S. Pat. No. 4,943,885 to Willoughby et al., U.S. Pat. No. 5,207,178 to McDade et al., U.S. Pat. No. 5,146,207 to Henry et al., and U.S. Pat. No. 6,091,597 to Lin. The electrodes 12 are oriented along the concave surface of the bottom side 4 so that they are in direct contact with the wearer at all times, whether directly on the skin of the wearer or on the wearer's clothing. It is therefore an object of the present invention for the power source 2 to be able to deliver an electric shock to the wearer through clothing; the power source 2 need not be in direct contact with the wearer's skin to be effective. The proper amount of contact is achieved and maintained by the belt 18 of the power source 2, which serves to secure the power source 2 to the wearer and thus retain the electrodes 12 in the proper position along the body of the wearer so as to be able to deliver a sufficiently disabling electric shock to the wearer.

Figure 3:
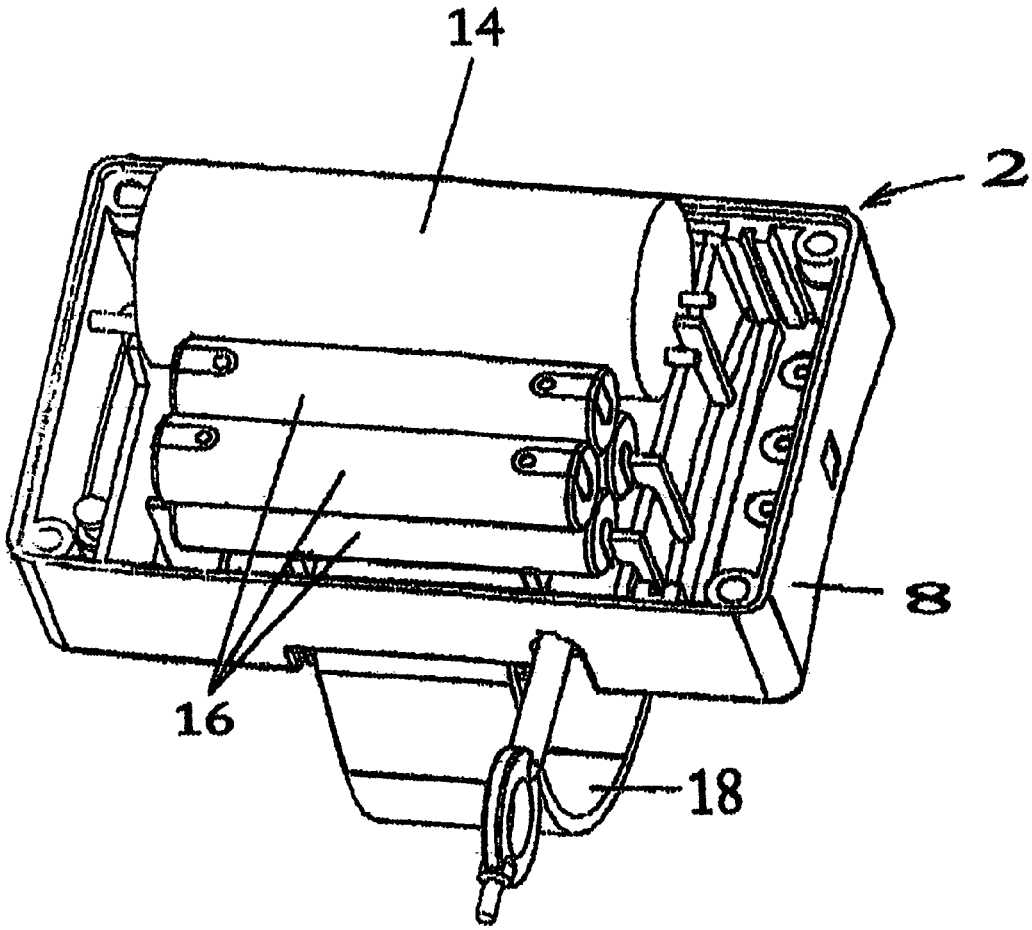
FIG. 3 is an internal perspective view of the power source depicted in FIG. 1.

Referring now to FIG. 3, a power source 2 in accordance with certain other embodiments of the invention is presented, with the top half 6 removed to show the interior structures. In order to deliver the shock to the wearer at the desired time, the power source 2 contains an internal electric circuit 14 capable of generating a temporary, repeatable, high-voltage, low-current electrical discharge that is delivered to the wearer via the electrodes 12. In the presently preferred embodiment, the current supplied by the power source 2 is relatively low due to the limitations of the electrical power supply 16, which is a standard 7.4 volt "lithium" type battery in the preferred embodiment, and the power source 2 is thus not operable to deliver a non-fatal shock to the wearer. However, the power supply 16 is sufficiently strong so as to be able to deliver a high-voltage shock that is capable of causing pain and temporary paralysis to the wearer of the power source 2. The electrical circuit 14 may be of any kind capable of achieving the desired high-voltage, low-current output, such as an oscillator-resonant circuit coupled with a step-up transformer, a diode-capacitor voltage multiplier, or similar electrical circuit. In the presently preferred embodiment, the electrical circuit is operable to administer the shock to the wearer in a series of intermittent (pulsatile), low-amperage, low-current, high-voltage shocks, each of short duration, such as 2-3 seconds. The shocks may be repeatedly delivered to the wearer by the power source 2 in approximately five second intervals, for so long as the electrical power supply 16 is capable of generating sufficient power to deliver a shock.

It is also an object of the present invention for the power source 2 to be configured to deliver electric shocks across a wide range of voltages. Therefore, in some embodiments the electrical supply 16 of the power source 2 is configured to be able to generate and deliver a relatively low-voltage electric shock, such as 40,000 volts, to the wearer through the electrodes 12. In other embodiments, the electrical supply 16 of the power source 2 is configured to deliver a relatively high-voltage electric shock, such as approximately 80,000 volts, and in still other embodiments, the electrical supply 16 is configured to deliver an electrical shock of intermediate voltage, such as approximately 60,000 volts. Therefore, the presently preferred embodiment of the power source 2 includes an electrical supply 16 capable of generating one, or all, of the aforementioned electrical discharges and the power source 2 is sufficiently scalable so as to be configured to deliver any of the same.

In many of the embodiments of the present invention, the power source 2 is configured to track (GPS), monitor (alcohol), communicate (voice) and deliver an electric shock that is sufficient to immobilize the wearer, even through layers of clothing such as socks or shirt sleeves, without being lethal. The electrical discharge delivered by the power source 2 causes the wearer's nervous system to experience a brief, temporary failure, which results in a contemporaneous temporary paralysis of the skeletal muscles for so long as the shock is applied to the wearer. This paralysis manifests itself as the wearer's muscles twitching uncontrollably, as if in spasm. The wearer will also experience severe pain from the electrical discharge generated by the power source 2. Notwithstanding these symptoms, the wearer will experience a complete recovery in approximately ten minutes after delivery of the shock, with wearer able to full regain control of his or her body.

As can be appreciated, by simultaneously delivering pain and causing temporary paralysis, the power source 2 can completely immobilize the wearer virtually instantly, allowing the remote monitoring center to control the wearer quickly and efficiently, with no harm done to the public that may be close to the wearer of the power source 2. Additionally, because the power source 2 is operated by a remote monitoring center, immobilization of the wearer can be achieved from a distance, thereby allowing the remote monitoring center to prevent a situation where a person being monitored may attempt to cause harm or violate the rules of their release.

Figure 4:
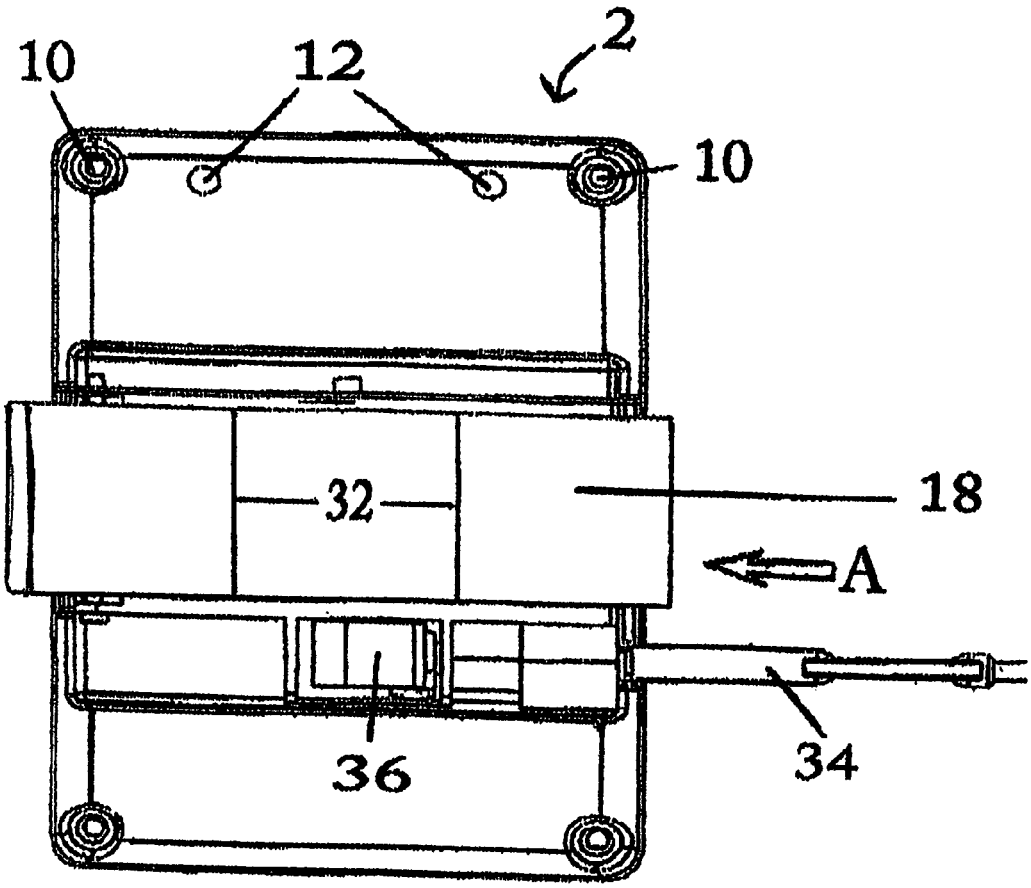
FIG. 4 is a perspective view of a locking mechanism in accordance with at least some embodiments of the present invention.
Figure 5:
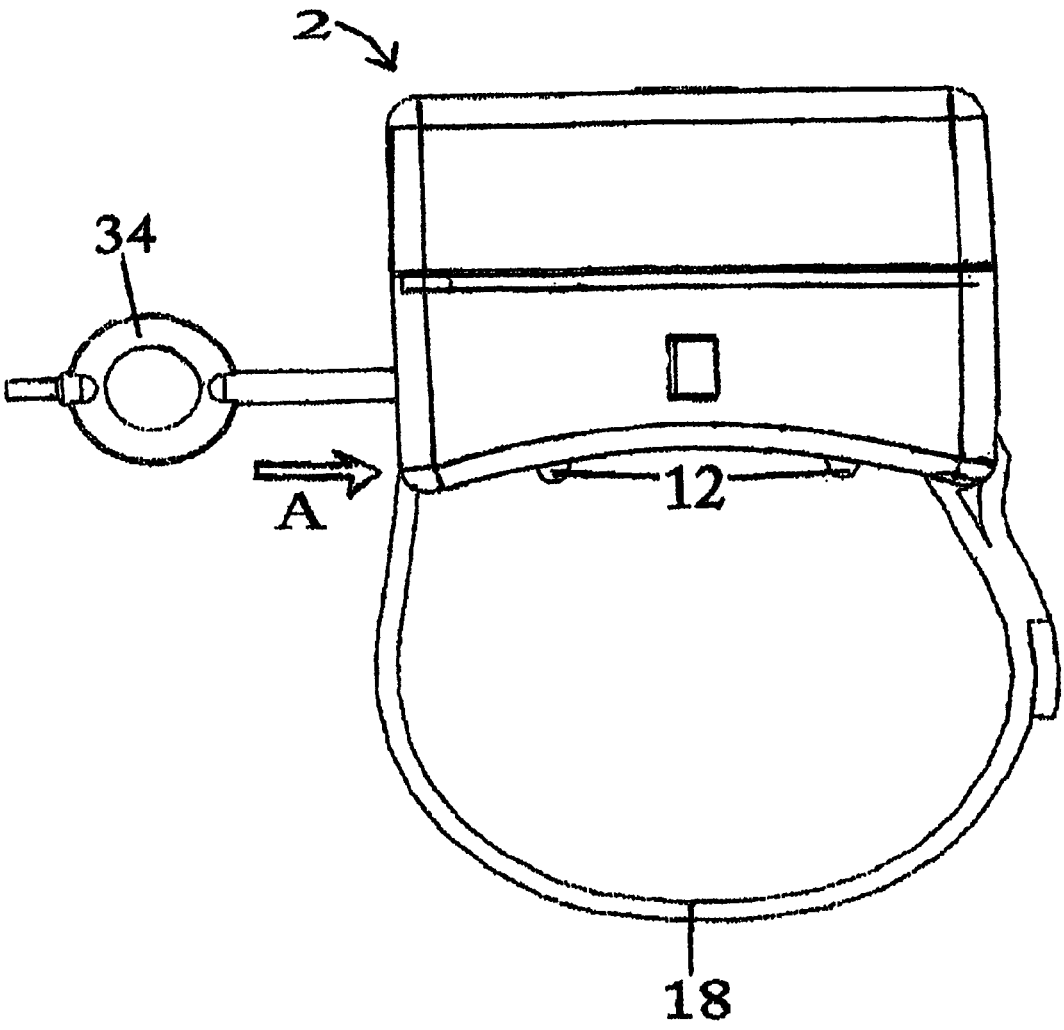
FIG. 5 is a side perspective view of the locking mechanism depicted in FIG. 4.

Referring now to FIGS. 4 and 5, a locking mechanism in accordance with certain embodiments of the present invention is presented. In the depicted embodiment, the locking mechanism includes a band 18, capable of being tightened to a plurality of sizes, which serves to hold the power source 2 in place at the desired location on the wearer. In that regard, the band 18 also serves to hold the electrodes 12 securely in place against the wearer of the power source 2 or the wearer's clothes, thereby ensuring sufficient contact with the wearer for delivery of the electric shock, tracking (GPS), monitoring (alcohol) and communicating (voice). The locking mechanism is therefore preferably included with all embodiments of the power source 2 and it is intended that any number of appropriate locking mechanisms may be employed with the power source 2, such as handcuff-style locks, shackles, straps, and similar locking mechanisms. In the presently preferred embodiment, however, the locking mechanism is a ratchet that includes a pawl (not shown) that, when engaged, is held against the band 18 by a plurality of magnets (not shown). The band 18 is therefore preferably of a ratchet or cog configuration and includes a plurality of ridges or teeth 32 along its length that contact the pawl when the locking mechanism is engaged. In regard, but not portending to be limited in any manner, the following U.S. patents are incorporated herein by reference to assist in providing a written description of how the present invention may be configured to create a key operated restraining device with a securing loop of adjustable dimension, and therefore how one of skill in the art may implement one or more embodiments of the present invention: U.S. Pat. No. 6,446,474 to Tabacci, et al. In the preferred embodiment, the ratchet mechanism of the locking mechanism generally works because the band 18 has triangular ridges or teeth 32 set off at an angle, and a metal pawl that rest against the band 18 when locking mechanism is engaged. The teeth or ridges 32 are angled such that when the band 18 is inserted into the power source 2 in the direction of the arrow "A," the pawl rises as it slides over the rise of each ridge or tooth 32 and then clicks down over the lip of each ridge or tooth 32 to the level of the band 18. Because of the triangular shape of the ridges or teeth 32, the pawl becomes located and abutted against a flat surface of the triangular ridge or tooth 32 and is prevented from moving back up over the lip of each ridge or tooth 32. The flat surface therefore prevents the band 18 from moving backward each time it clicks down over a ridge or tooth 32. Therefore, when engaged, the locking mechanism permits movement of the band 18 in the tightening direction only (e.g. in the direction of arrow "A"). If the band 18 is pulled backward against the direction of arrow "A" the pawl and the flat surface of the lip of the engaged tooth or ridge 32 will make contact, preventing any backward movement. To further ensure that the locking mechanism will be effective, the pawl is preferably constructed of a magnetic metal, such as iron, steel, cobalt, nickel or similar magnetic materials, and is configured to be held down against the band 18 (and thus in contact with a flat surface of the lip of the engaged tooth or ridge 32) by a plurality of magnets (not shown). When configured in this way, the magnets assist the pawl in clicking down over the lip of each ridge or tooth 32 and also serve to hold the pawl to the level of the band 18 when the locking mechanism is engaged. As can be appreciated, the magnets add strength and stability to the locking mechanism, thereby helping to ensure that the power source 2 is securely held onto, and against, the wearer for optimal tracking (GPS) and/or monitoring (alcohol), communicating (voice) and delivery of the electric shock.

The Pawl becomes automatically engaged when the band 18 is inserted into the power source 2 along the direction of arrow "A" and remains engaged until such time as a key 34 of the proper configuration is inserted into the power source 2 and turned in such a way so as to release the pawl from the magnets, thereby releasing the locking mechanism and allowing the band 18 to be loosened. When properly turned, the key 34 of proper configuration activates a release mechanism 36 inside of the power source 2. The release mechanism 36 is configured in such a way that, when the key 34 is not inserted in the power source 2, the release mechanism 36 is not in contact with the pawl and the locking mechanism is engaged with the band 18. When the key 34 is inserted into the power source 2 and properly turned, the key 34 causes the release mechanism 36 to raise the pawl to a height above the lip of each ridge or tooth 32, allowing the band 18 to be loosened and even removed from the power source 2. In some embodiments, the release mechanism 36 simultaneously moves the magnets away from the pawl as it moves as it moves the pawl away from the band 18 to a height above the lip of each ridge or tooth 32, thereby increasing the distance between the pawl and the magnets and reducing the attractive forces between the pawl and plurality of magnets.

The present invention, in various embodiments, includes components, processes, systems and/or apparatuses substantially as depicted and described herein, including various embodiments, subcombinations, and subsets thereof. Those of skill in the art will understand how to make and use the present invention after understanding the present disclosure. The present invention, in various embodiments, include providing devices and processes in the absence of items not depicted and/or described herein or in various embodiments hereof, including the absence of such items as may have been used in previous devices or processes, e.g., for improving performance, achieving ease and/or reducing cost of implementation.

The forgoing discussion of the invention has been presented for the purpose of illustration and description. The forgoing is not intended to limit the invention to the form or forms disclosed herein. In the foregoing Detailed Description for example, various features of the invention are group together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover though the description of the invention has included descriptions of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

SUMMARY

What in need is means by which an individual on parole or probation may be tracked (GPS) and monitored (alcohol) and communicated (voice) to and the ability to have non-lethal control by probation officers, law enforcement officers and the courts while the parolee or probationer is in public situations, while allowing that person to maintain their mobility in public locations, it is also necessary to achieve a means by which to track (GPS), monitor (alcohol) communicate (voice) with and quickly pacify that person, effectively and in a non-lethal way in public situations, without providing the ability for those persons to remove the means of tracking (GPS), monitoring (alcohol), communicate (voice) or electroshock stun control by law enforcement without placing members of the general public at risk of harm.

It is therefore an object of the present invention to provide a fully automated, remote controlled power source for tracking (GPS), monitoring (alcohol) communicating (voice) with and administering a non-lethal, pulsating, incapacitating electric shock to a person at a specific point of contact on the parolee/probationers body, in combination with a remote telephone, global positioning satellite or radio transmitter that is operable to deliver an operational signal to the power source to trigger the pulsating electroshock. In some embodiments, the power source is a single, small unit capable of being placed on the wrist, ankle or upper arm, or other areas where it may be hidden beneath clothing, the object of the current invention shows only the remote controlled electroshock device without the telephone and global positioning satellite hardware. In some embodiments all hardware would be housed in a single unit. The power source includes a locking mechanism configured to hold the power source securely to the wearer at the desired location, which mechanism is incapable of being unlocked and removed without a key. In some embodiments, the power source is operable to deliver a low-level electric shock to the wearer, while in other embodiments, the power source is operable to deliver a high-level electric shock, and in still other embodiments the power source can track (GPS), monitor (alcohol) and communication (voice) and the device can deliver a pulsating, incapacitating electroshock to the wearer. The electric shock delivered by the power source is therefore sufficiently scalable so as to be configured to deliver any voltage to the wearer from approximately 40,000 volts up to approximately 80,000 volts. In all embodiments, the power source is configured to deliver an electric shock that is sufficient to immobilize the wearer, even through layers of clothing such as socks or shirt sleeves, without being lethal.

In some embodiments, regardless of the level of electric shock produced, the power source is configured to deliver the electric shock to the wearer through two electrodes located on the back side of the power source, which are placed into direct contact with the wearer. When activated by remote control, a pulsating, incapacitating electroshock is delivered to the wearer through these electrodes. In order to be activated by a remote control, the power source contains a receiver configured to receive a specific set of signals transmitted by the monitoring center, such as a coded on/off power activation signal and a coded electroshock activation signal. In order to deliver the incapacitating electroshock to the wearer at the desired time, the power source also contains an electric circuit operably connected to the radio receiver, configured such that when a pulsating, electroshock activation signal is received by the power source, the electric circuit is completed through the body of the wearer, and the shock delivered.

Also in some embodiments, the power source includes a banded, magnetically operated, locking mechanism with a ratchet or cog band that serves to hold the power source in place at the desired location on the wearer, in that regard, the locking mechanism also serves to hold the electrodes securely in place and ensures sufficient contact with the wearer for delivery of the shock. As described in greater detail below, the locking mechanism features a reversible pawl that, when engaged, is held in place at any one of a plurality of locations along a ratchet or cog band by a plurality of magnets and which serves to restrict the motion of the band in a direction that would loosen it from the wearer's body. The pawl is automatically activated when the band is inserted into the appropriate location in the power source and remains activated until such time as a key of the proper configuration is inserted into the power source and turned in such a way so as to release the magnets holding the pawl in place, thereby releasing the locking mechanism.

What is claimed is:

1. An apparatus for tracking by global positioning system (GPS), transdermal (alcohol) monitoring, cellular (voice) communication and administering an incapacitating electric shock to a person, comprising: a portable power source weighting less than 16 ounces; at least one pair of electrodes operatively associated with said power source, said electrodes configured to deliver a predetermined amount and duration of electric shock to a person's body; a locking mechanism configured to secure the electrodes at a desired position on said person's body, said locking mechanism comprising a ratchet operatively associated with a band and magnetic means for reversibly engaging a pawl with said band; a remote control, a power source, and a means for generating and transmitting at least one specific radio signal; and wherein said power source is adapted to receive said at least on specific radio signal and in response thereto, subsequently generate a low current electric shock in the range of about 40,000 volts to 80,000 volts.

2. An apparatus for tracking by global positioning system (GPS), transdermal (alcohol) monitoring, cellular (voice) communication and administering an incapacitating electric shock to a person, comprising: a portable power source capable of generating an electric shock in response to a least one specific radio signal; at least one pair of electrodes operatively associated with said power source, said electrodes configured to deliver said electric shock to said person's body; a locking mechanism configured to secure the electrodes at a desired position on said person's body; said locking mechanism comprising a ratchet operatively associated with a band and a magnetic means for reversibility engaging a pawl with said band; a remote, a power source, and a means for generating and transmitting at least one specific radio signal; and wherein said power source, is adapted to receive said at least one specific radio signal and in response thereto, subsequently generate an electric shock to said person's body.

3. The apparatus of claim 2, wherein said apparatus can be tracked by Global Positioning Satellite (GPS).

4. The apparatus of claim 2, wherein said apparatus can monitor a wearers alcohol level.

5. The apparatus of claim 2, wherein said apparatus is equipped to communicate (voice) with said person's.

6. The apparatus of claim 2, wherein said apparatus has a power source of less than 16 ounces.

7. The apparatus of claim 2, wherein the electrodes of said apparatus are further configured to deliver said electric shock to said person's body at a predetermined amount and duration.

8. The apparatus of claim 2, wherein the electric shock is a low current high voltage electric shock.

9. The apparatus of claim 2, wherein the electric shock is administered in the range of about 40,000 volts to 80,000 volts.

10. A method for tracking by global positioning system (GPS), transdermal (alcohol) monitoring, cellular (voice) communication and administering an incapacitating electric shock to a person, comprising; providing a portable power source weighing less than 16 ounces wherein said power source is adapted to receive at least one specific radio signal and in response hereto, subsequently generate a low current electric shock in the range of about 40,000 volts to 80,000 volts; providing at least one pair of electrodes operatively associated with said power source, said electrodes configured to deliver said electric shock to said person's body, providing a licking mechanism configured to secure the electrodes at a desired position on said person's body, said locking mechanism comprising a ratchet operatively associated with a band and a magnetic means for reversibly engaging a pawl with said band, securing the electrodes to the person's body by tightening the band of the locking mechanism onto the person's body; a means for receiving at least one specific radio signal at the power source; and administering the electrical shock from the power source to the person in response to the at least one specific radio signal.

* * * * *